United States Patent [19]

Shaw et al.

[11] Patent Number: 4,800,968

[45] Date of Patent: Jan. 31, 1989

[54] WELL APPARATUS WITH TUBULAR ELEVATOR TILT AND INDEXING APPARATUS AND METHODS OF THEIR USE

[75] Inventors: Daniel G. Shaw, Conroe; Billy M. Cline, Houston, both of Tex.

[73] Assignee: Triten Corporation, Houston, Tex.

[21] Appl. No.: 99,771

[22] Filed: Sep. 22, 1987

[51] Int. Cl.[4] ..... E21B 19/00

[52] U.S. Cl. ..... 175/85; 175/202; 175/203; 166/66.5; 166/77.5; 414/22.52

[58] Field of Search ..... 166/77.5, 85, 66.5; 175/52, 85, 161, 202, 203; 414/22

[56] References Cited

U.S. PATENT DOCUMENTS

| | | | |
|---|---|---|---|
| 1,377,575 | 5/1921 | Greve | 173/57 |
| 2,488,107 | 11/1949 | Abegg . | |
| 2,772,074 | 11/1956 | Stoffa . | |
| 2,863,638 | 12/1958 | Thornburg . | |
| 3,063,509 | 5/1959 | Guier | 175/85 |
| 3,312,294 | 4/1967 | Wilson | 175/85 X |
| 3,464,507 | 9/1969 | Alexander et al. | 175/85 |
| 3,494,484 | 7/1967 | McFadden | 414/22 |
| 3,498,586 | 12/1967 | Turner, Jr. | 414/22 X |
| 3,695,669 | 10/1970 | Langowski | 294/82 R |
| 3,857,450 | 12/1974 | Guier | 175/85 |
| 3,915,244 | 10/1975 | Brown | 166/77.5 X |
| 4,326,745 | 6/1980 | Guier | 294/90 |
| 4,421,447 | 3/1981 | Guier | 414/22 |
| 4,423,774 | 1/1984 | Mefford | 166/77.5 |
| 4,449,596 | 5/1984 | Boyadjieff | 175/85 |
| 4,453,884 | 8/1982 | Gudgel | 414/22 X |
| 4,489,794 | 12/1984 | Boyadjieff | 175/85 |
| 4,625,796 | 2/1986 | Boyadjieff | 175/85 X |

OTHER PUBLICATIONS

Varco General Catalog 1984 pp. 5–8 (Top drive with link tilt); p. 28 (link); pp. 30, 34 (elevator, link).

Varco Top Drive Drilling System Description and Specifications 1985; pp. ii, 4, 16, 18, 24, 29, 31.

"DC Electric Power Swivel Can Save Time and Money" WORLD OIL, Jan. 1972; Top drive and tilting swivel.

"Drilling with Top Head Drives," Bowen Tools, Inc., D. Slator, prior to Oct. 1983; pp. 6–7 (IV–E) FIG. 2; FIG. 3.

"Trends in Rig–Floor Technology", Oil & Gas Journel, G. Boyadjieff, Aug. 1981; Top Drive.

Composite Catalog, BJ section, 1986; pp. 8, 16, 33 Top drive, air swivel ring, link tilt, links.

Composite Catalog, BJ section 1980; pp. 8, 38, 41 air swivel ring, elevator, link stabilizer, links.

Composite Catalog, Industrial Export Section, 1980; p. 4102 elevator, links.

Composite Catalog King Oil Tools, Inc.; p. 4265 elevator links, elevator stabilizer.

Composite Catalog King Oil Tools, Inc. section, 1980; pp. 4360–4361 elevator links.

*Primary Examiner*—Stephen J. Novosad

*Assistant Examiner*—John F. Letchford

*Attorney, Agent, or Firm*—Vaden, Eickenroht, Thompson & Boulware

[57] ABSTRACT

An elevator bail with elongated slots, an elevator tilting assembly and indexing apparatus, and a top drive drilling unit in combination with such devices that are connected to the upper end of a drill string and movable upwardly and downwardly with the drill string along a guide apparatus and that can be provided with a pipe handling mechanism for lifting and positioning the drill string which can can be swung about a vertical axis to a more advantageous attitude for loading or unloading drill pipe. Movement about the vertical axis can be achieved through the use of an air or hydraulic cylinder. Fitted about the top drive central shaft can be a rotable air conducting sealing gland and about its perimeter an annular ring containing a target material that is sensitive to a proximity switching device. The annular ring is rotable through an infinite angular travel and is able to be secured against unwanted rotation. In conjunction with the rotable annular ring is a hydro-electric circuit which will through a natural sequence of action, direct fluid under pressure to a top drive motor which will then rotate an elevator link/drill pipe elevator combination to a predetermined and desired angular displacement relative to a fixed work stand, from which drill pipe is loaded and unloaded from the elevator by a person or persons standing upon the work stand.

17 Claims, 12 Drawing Sheets

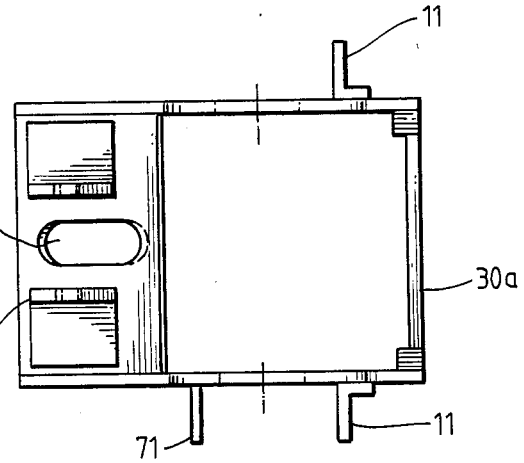
Fig.13
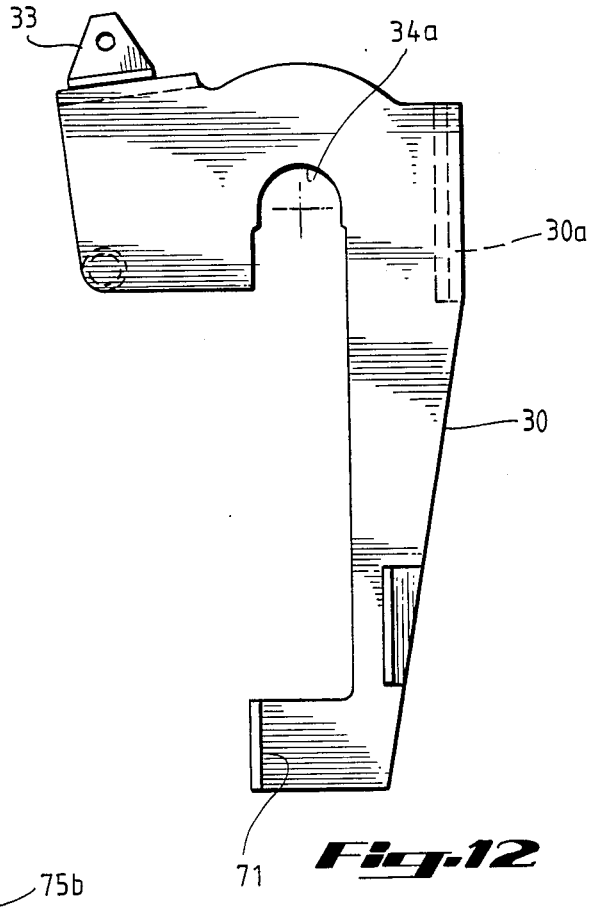
Fig.12
Fig.14
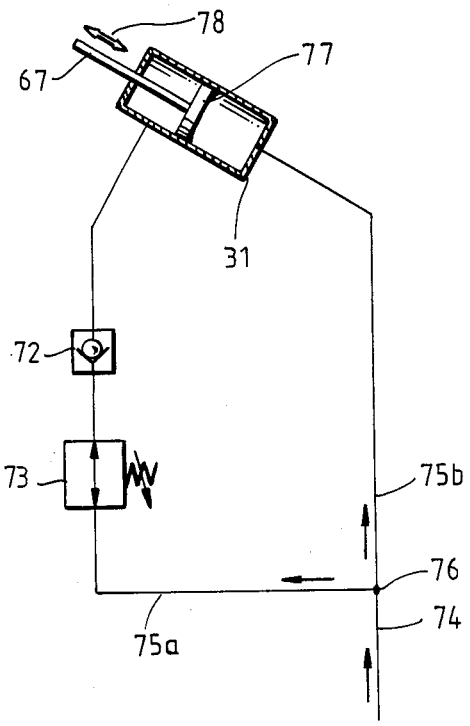

WELL APPARATUS WITH TUBULAR ELEVATOR TILT AND INDEXING APPARATUS AND METHODS OF THEIR USE

FIELD OF THE INVENTION

This invention is directed to apparatus for supporting and locating a section of drill pipe or other tubular in a well rig, to an indexing mechanism for correct positioning of the tubulars at a desired location, and to a top drive in combination with such apparatuses.

DESCRIPTION OF PRIOR ART

In working on a well drilling rig a length of drill pipe is lifted and moved from a stored position to a position at which the drill pipe is connected to a drill string. Lifting equipment that is usually used includes a conventional elevator that grips a protuberance machined on the end of a drill pipe. The drill pipe is loaded at an elevated location in the derrick by a person ("derrick man") standing on the derrick structure. Often a device called an elevator is used to grip and hold pipe. Elevators have lateral doors which should be oriented toward the derrick man otherwise he cannot push a pipe into the elevator. Proper indexing requires that the open door of a pipe elevator be in the proper angular position. When "tripping" in or out (that is removing or adding all the drill pipe, e.g. when it is desired—to change a drill bit); it is advantageous for the drill pipe elevator open "door" to point toward the derrick man. In as much as the natural action of the drill pipe is spiraling as it is withdrawn, an automatic method of re-positioning is desired. Otherwise the elevator has to be positioned manually, which is time consuming. A variety of problems are encountered in moving the drill pipe from a lateral position to a desired point over the well, usually the central longitudinal axis of the wellbore and rig. These problems include: the safety of the personnel handling the drill pipe or other tubular; the correct accurate positioning and indexing of the pipe and the great physical effort by one or more persons required to move the pipe. Often valuable time is expanded in such an operation.

These problems are apparent when considering such prior art as the mechanism disclosed in U.S. Pat. No. 4,489,794. This patent's mechanism has a number of disadvantages.

This tilt mechanism is used in conjunction with a torque wrench and cannot be rotated separately from the torque wrench. Also, since the prior art mechanism cannot be intentionally rotated by powering its central shaft, the elevator cannot be used to rotate a drill pipe hanging within its support shoulder. Therefore, this prior art mechanism cannot be used to make up or spin out of the threaded connection. This requires another method of rotating the drill pipe such as an "iron roughneck", an expensive make-up/break-out tool, or a manual "spinning chain" which is very dangerous.

The prior art tilt actuator disclosed in U.S. Pat. No. 4,489,794 is a one way "air bag"—it powers outwardly only. Gravity is required to return it to a vertical position and this is erratic and sometimes not achieved because of the inherent imbalance of the system. The prior art mechanism of U.S. Pat. No. 4,489,794 cannot be used to drill down to the rig floor because the torque wrench surrounds the central shaft and it cannot be moved laterally out of the way. A drag link must be used as well as cable to elevate the elevator.

There has been a long-felt need for efficient and safe tilt apparatus, indexing apparatus, and top drives for well rigs which solve these problems. The present invention recognizes, addresses, and satisfies this long-felt need.

In accordance with 37 C.F.R. S1.56 the following references are disclosed:

| | |
|---|---|
| U.S. Pat. Nos. | |
| 1,377,575 | Bails 10; FIGS. 1, 2 |
| 2,488,107 | Elevator 18, bails 19; FIG. 2 |
| 2,772,074 | Elevator 35, bail 37; FIG. 1 |
| 2,863,638 | Rotary drive on frame movably mounted on derrick |
| 3,464,507 | Swinging elevator 144 with hydraulic rams 145 connected to side members 134, 135 and to elevator bails 143; FIG. 6; Col. 6, lines 53–64 |
| 4,489,794 | Link Tilt Mechanism |
| 4,449,596 | Top Drive |
| Publications | |
| Varco General Catalog 1984 | pp. 5–8 (Top drive with link tilt); p. 28 (link); pp. 30, 34 (elevator, link) |
| Varco Top Drive Drilling System Description and Specifications 1985 | pp. ii, 4, 16, 18, 24, 29, 31 |
| "DC electric power swivel can save time and money" WORLD OIL, Jan. 1972 | Top drive and tilting swivel |
| "Drilling with Top Head Drives," Bowen Tools, Inc., D. Slator, prior to Oct. 1983 | pp. 6–7 (IV-E); FIG. 2; FIG. 3 |
| "Trends in rig-floor technology", Oil & Gas Journel, G. Boyadjieff, Aug. 1981 | Top Drive |
| Composite Catalog, BJ section, 1986 | pp. 8, 16, 33 Top drive, air swivel ring, link tilt, links |
| Composite Catalog, BJ section, 1980 | pp. 8, 38, 41 air swivel ring, elevator, link stabilizer, links |
| Composite Catalog, Industrial Export Section, 1980 | p. 4102 elevator, links |
| Composite Catalog King Oil Tools, Inc. | p. 4265 elevator links, elevator stabilizer |
| Composite Catalog King Oil Tools, Inc. section, 1980 | p. 4360–4361 elevator links |

SUMMARY OF THE INVENTION

The present invention is directed to apparatuses and methods including power actuated means for moving pipe or tubulars to overcome the problems of the prior art devices. The apparatus according to the present invention includes a power actuator for moving a pipe gripping device such as an elevator. The pipe gripping device can be positioned below a top drive or suspended from it. The power actuator can also serve as a positive power return device to provide powered inwardly tilting movement. The present invention can also have a rotable air sealing gland to convey compressed air to the power actuator, and an adjustable ring that contains a material sensitive to a proximity switch. Used in conjunction with a control circuit, the switch can initiate powered rotary indexing of the elevator.

The present invention also teaches an elevator support link that has an elongated slot which provides a support point for the elevator and allows the separation of the elevator bowl from the top drive to diminish. This allows drilling to within 10–12 inches of the floor compared to 40–45 inches with prior art devices. This is important because, when drilling ahead, the bit is picked up only about 36–40 inches which means the threaded joint is at a comfortable elevation for a man standing on the floor to apply tongs and break the joint. With prior art devices this work must be done 60–65 inches up in the air which is very awkward for a man standing on the floor. The elongated slot guides the link and maintains its vertical position, particularly when drilling the last thirty to thirty-six inches above the rig floor.

An elevator link adapter is also disclosed which is connectible to a top drive shaft. The link adapter has elements projecting from each side to form a support for the elevator links. Power actuation and rotational indexing of the elevator is accomplished by an electrohydraulic control circuit.

It is therefore an object of the present invention to provide a novel, efficient, safe and nonobvious tubular elevator for use in well rigs.

It is also an object of this invention to provide a novel, efficient, safe and nonobvious indexing mechanism for such an elevator.

It is also an object of this invention to provide a nonobvious elevator tilt device.

Another object of the present invention is the provision of power actuator apparatus for moving an elevator in a well rig or derrick.

Yet another object of the present invention is the provision of such a power actuator apparatus which can also serve as a positive power return.

A particular object of the present invention is the provision of a rotatable air sealing gland for conveying compressed air to the power actuator apparatus.

A further object of the present invention is the provision of an adjustable ring containing material sensitive to a proximity switch for controlling powered rotary indexing of an elevator.

An additional object of the present invention is the provision of an elevator support link having an elongated open slot that provides a support point for an elevator and allows the extent of separation between the elevator bowl and the top drive to diminish.

Another object of the present invention is the provision of an elevator link adapter which can be connected to the motive shaft of a top drive device. A particular object of the present invention is the provision of such an adapter which has extending projections for supporting elevator links.

Another object is the provision of a top drive in combination with such apparatuses and devices.

Yet another object of this invention is the provision of apparatus for the power actuation and rotational indexing of an elevator. A particular object of this invention is the provision of such apparatus which includes an electrohydraulic control circuit.

A further object of this invention is the provision of a device which can be used to drill down very close to the rig floor.

To one of skill in this art who has the benefit of the teachings of this invention, other and further features, objects and advantages will be apparent from the following description of presently-preferred embodiments, given for the purpose of disclosure, when taken in conjunction with the accompanying drawings.

DESCRIPTION OF THE DRAWINGS

FIG. 12 is a side view of the body of a tilt mechanism according to this invention and FIG. 13 is a top view of it.

FIG. 14 is a schematic view of the air cylinder of FIG. 1.

DESCRIPTION OF THE PREFERRED EMBODIMENTS OF THE INVENTION

Figure 1:
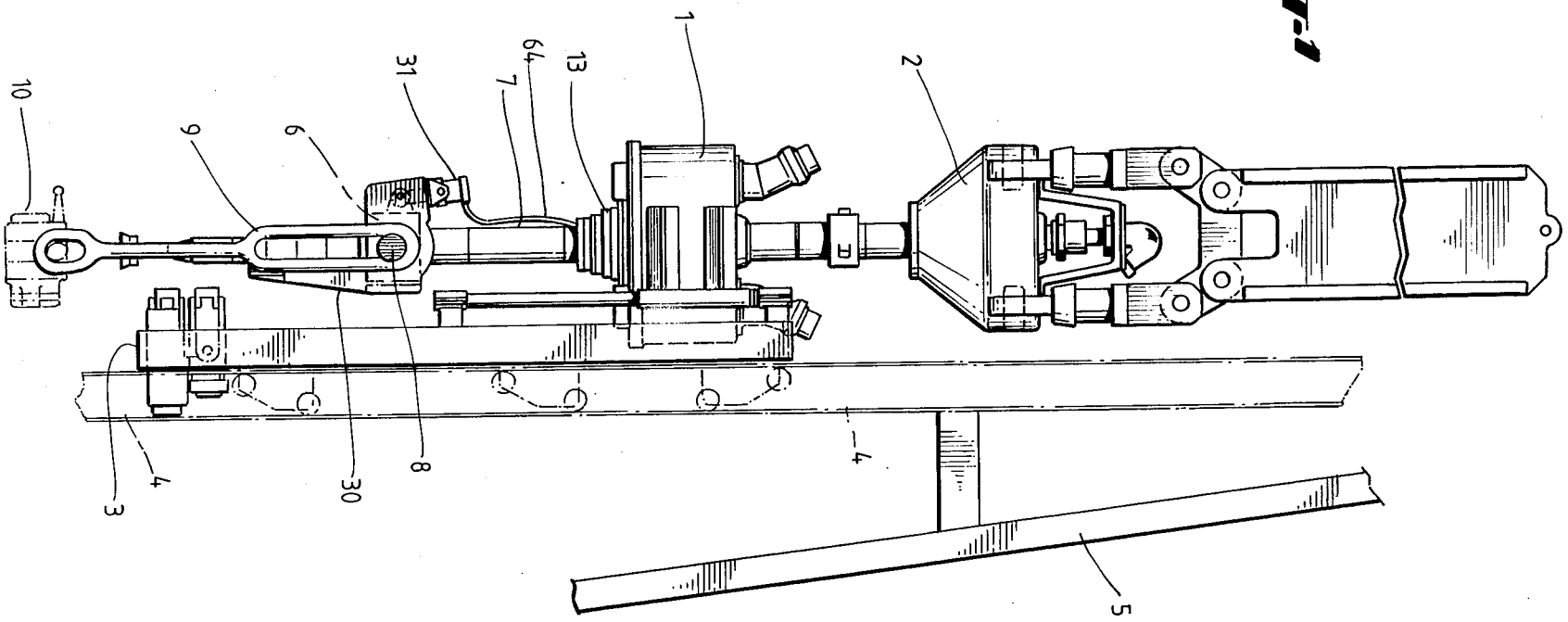
FIG. 1 is a side view of a top drive mounted in a well drilling derrick having an elevator bowl tilting mechanism and an automatic indexing means according to the present invention.

As shown in FIG. 1*a* a top drive 1 is threadably connected to a swivel 2, and is secured to and supported by a dolly 3 that is movably connected to guide rails 4 located on a derrick 5. An elevator link adapter 6 is threadably connected to a shaft 7 of the top drive 1. Pivotably attached to the link adapter 6 is a tilt mechanism 30 with an air cylinder 31. Hanging from a link adapter bail post or pin 8 is an elongated link or bail 9 that supports an elevator 10.

Figure 2:
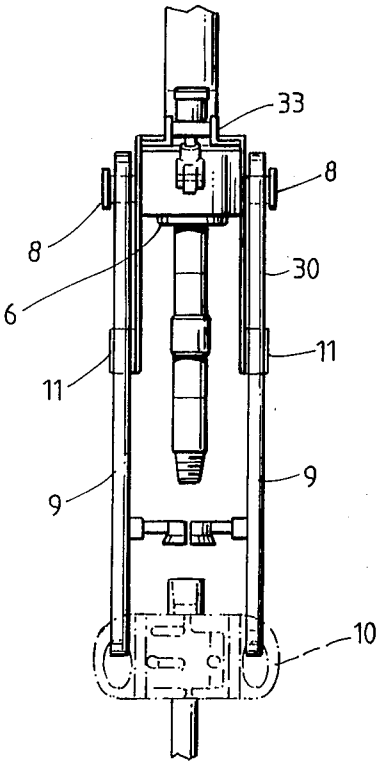
FIG. 2 is a partial front view of apparatus of FIG. 1 showing the tilting mechanism.

In FIG. 2 the two links 9 are shown suspended from the link pins 8. This drawing illustrates the projection 11 from the tilt mechanism 30 that contacts the links 9. As will be shown later, the projections 11 power the links 9 outwardly to a desired tilt angle.

Figure 3:
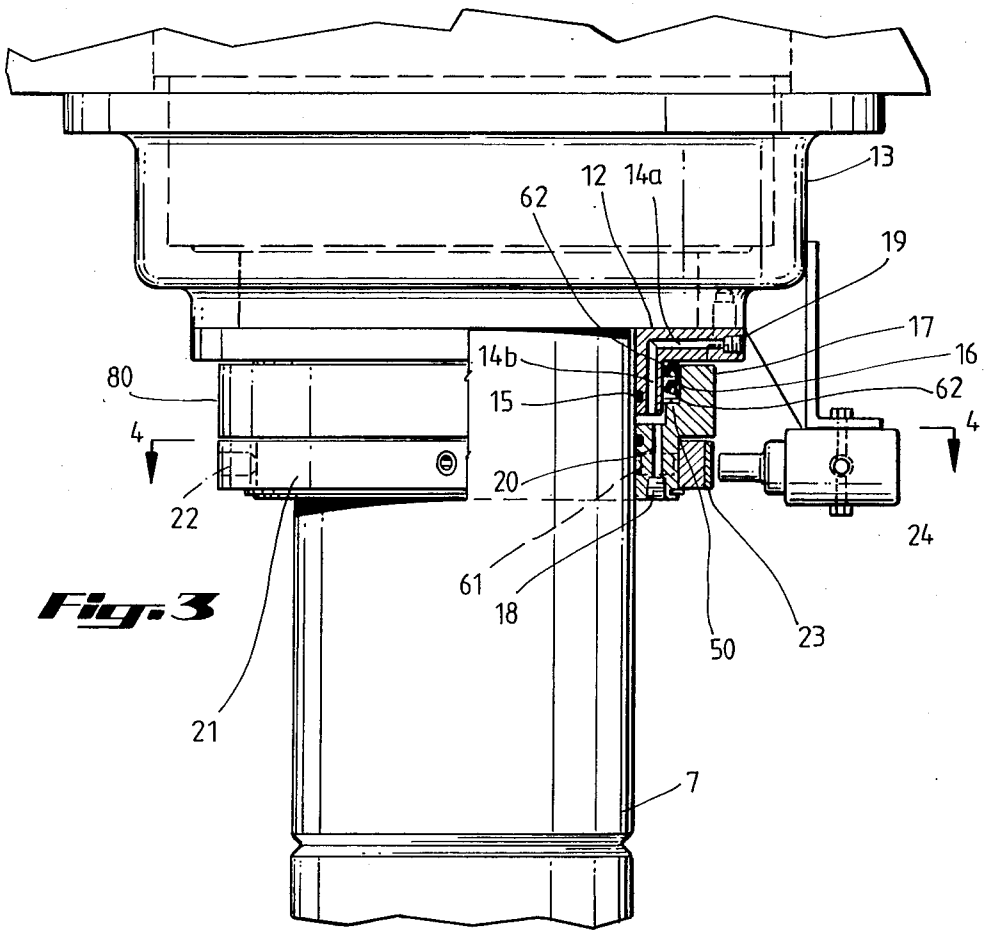
FIG. 3 is a view of an air swiveling gland of the apparatus of FIG. 1 in partial cross section.

FIG. 3 illustrates the air swivel ring assembly 80 in which air (or liquid) enters at a threaded connection 19 (from a conventional compressed air source, not shown) in a member 12 and is conducted through a rotating member, seal member 16, and then exits through port 18. In FIG. 3 an annular flanged seal member 12 is secured to the top drive housing 13. The said seal member is provided with an interconnecting system of passages 14*a* and 14*b* that convey a gas (or liquid) from an outer annulus 50 to an inner space 51 between surfaces of the member 16 and the shaft 7.

A sealing element 15 positioned between the rotating seal member 16 and a stationary member 12 prevents leakage through the inner annulus of the member 12. Radially disposed about the top drive shaft 7 and overlapping the annular member 12 is an outer air seal member 16 that is affixed to the top drive shaft 7 by the set screws 22 and rotates with that member. Sealing elements 15 prevent leakage through the inner annulus and sealing elements 17 abutting member 12 both during rotation and while member 12 is stationary, prevent leakage to the outside. A circular spring 62 assists in maintaining the sealing contact between the seals 17 and the surface of the member 12. A passage 20 conveys the gas (or liquid) through the member 16 so that a gas or liquid entering at an opening 19 will exit at a port 18 even though member 16 may be rotating with respect to 12. A hose 64 is connected to the port 18 and to an air cylinder 31.

An annular ring 21 is radially disposed about the member 16 in such a manner that, when lock screw 22 is not engaged, the entire ring 21 is free to rotate through a 360° angle (e.g. when it is desired to change the indexing position, i.e. the position at which the ring and therefore the string are stopped.) The annular ring 21 includes a magnetic material 23 of a specific mass that will, when in close proximity to a sensor switching device 24, excite the sensor switching device 24, positively positioning the top drive shaft 7 at a predetermined radial direction and thereby position the suspended elevator 10 at a desired direction such as with its door disposed for easy operation. Although a magnetic material is preferred any other suitable material and sensor therefor can be used; e.g., photoelectric sensors, radioactive material, material of a particular color, a light or light-emitting material or an ultrasonic emitter. Also this sensing may be accomplished with electronically programmable radial position electronic sensing devices commonly known as "Hall effect" sensors.

Figure 4:
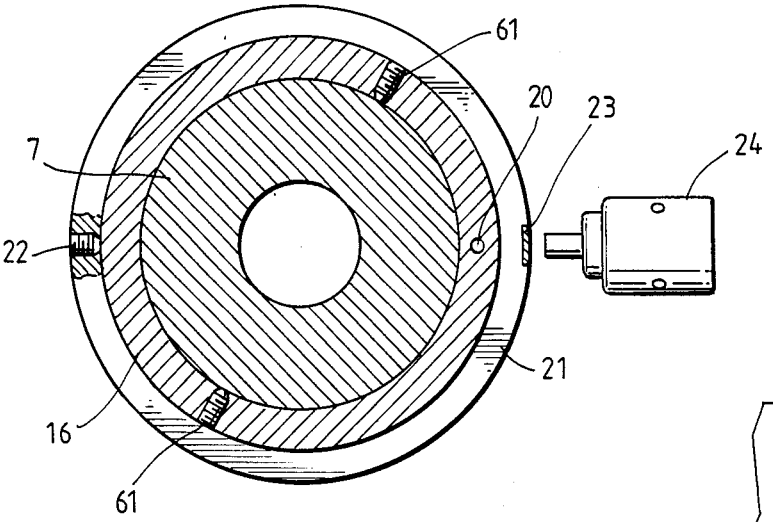
FIG. 4 is a top view of parts of the apparatus of FIG. 3.

FIG. 4 presents a sectional view along line 25—25 of FIG. 3. The various details are pictured to clarify the relationship. The annular ring 21 has the portion of magnetic material 23 disposed along its outer circumference. The switching device 24 is positioned so that it can be affected by the magnetic material 23. The outer air seal member 16 is disposed within the annular ring 21 and the shaft 7 of the top drive is connected to the member 16 with screws 61.

Figure 5A:
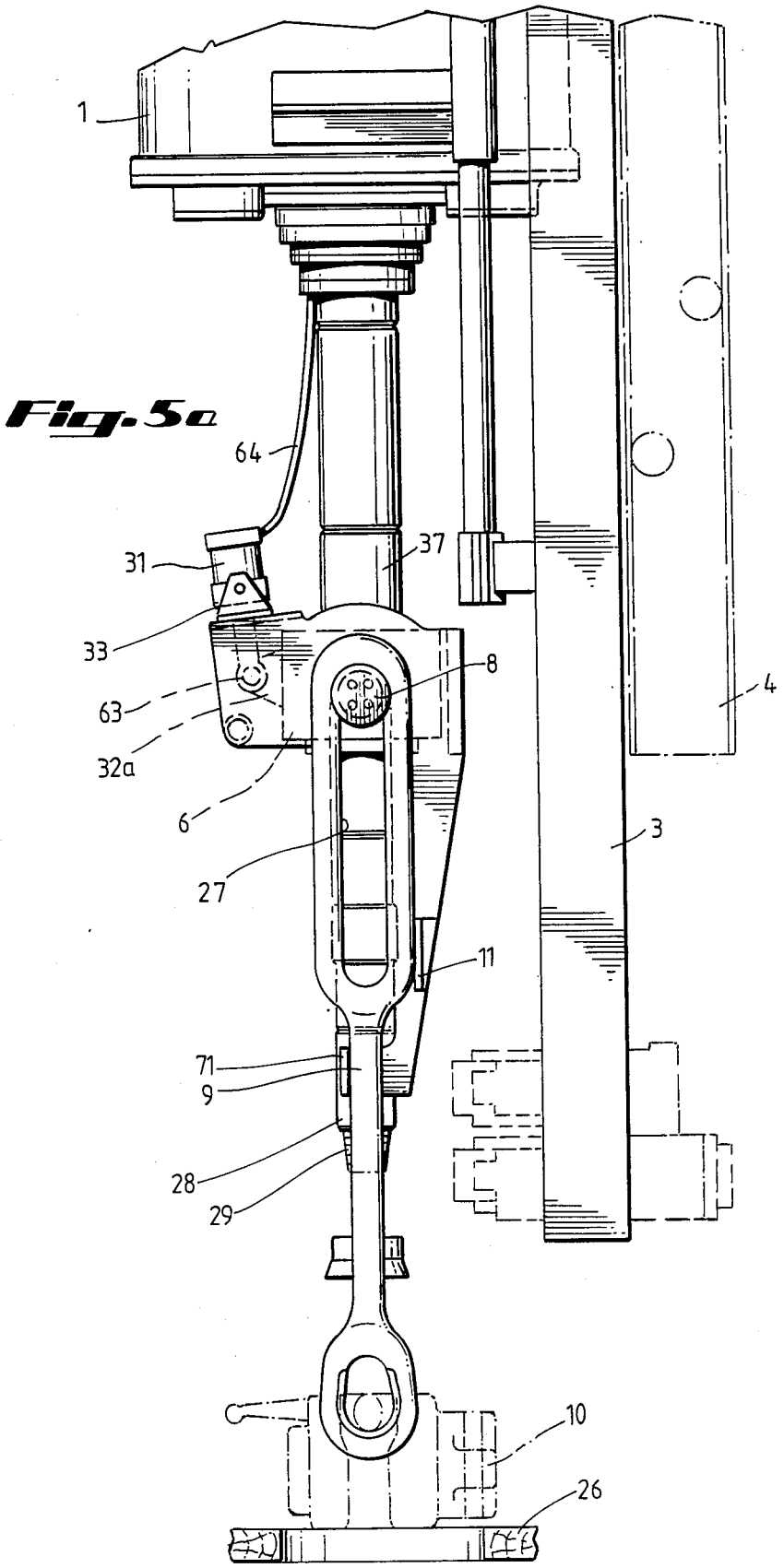
FIG. 5*a* is a diagrammic representation of a well drilling operation according to this invention.

As shown in FIG. 5*a*, the top drive 1 is pictured in a working mode after moving downwardly. The elevator 10 has contacted a stationary structural object 26 (such as a rig floor) that resists further downward movement of the elevator 10. The links 9 are still supported by the pins 8 and the tilt mechanism 30 has not tilted the links.

Figure 5B:
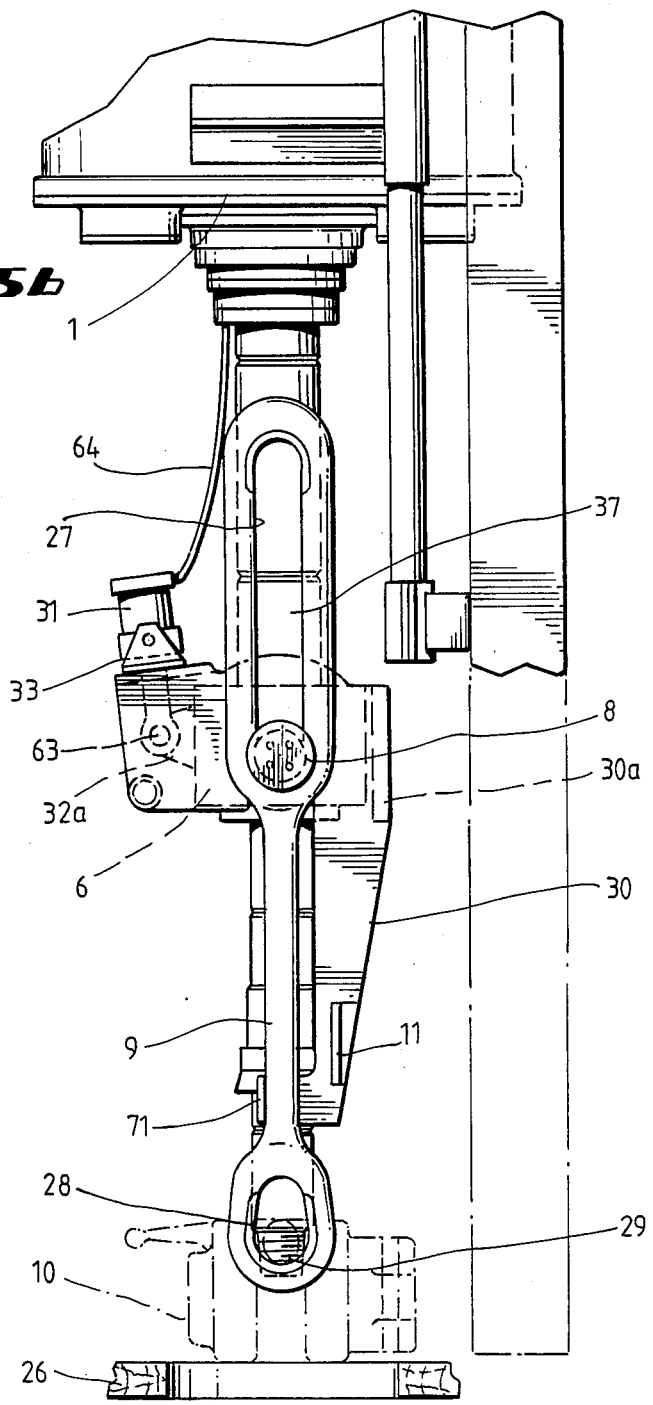
FIG. 5*b* is a sequential continuation of the drilling operation shown in FIG. 5*a*.

In FIG. 5*b* the top drive 1 is shown as having continued downward and the link adapter pin 8 has moved downward in the elongated slot 27 in the bail link 9. This has allowed the shoulder 28 to move closer to the stationary structure 26 that represents the floor of a drilling rig. The shoulder 28 is in very close proximity to the floor 26 and facilitates connection of additional drill pipe to the threaded element 29. To connect an additional pipe, the top drive 1 is hoisted upwards in the derrick 5 and when doing so, the pins 8 move up in the slots 27. When the pins 8 bottom out the threaded element 29 will be separated from the elevator 10 (raised upwardly in the derrick) by an amount which will allow the insertion of a new drill pipe within the support shoulder of elevator 10. The new drill pipe has a male threaded element on the bottom end.

Figure 6:
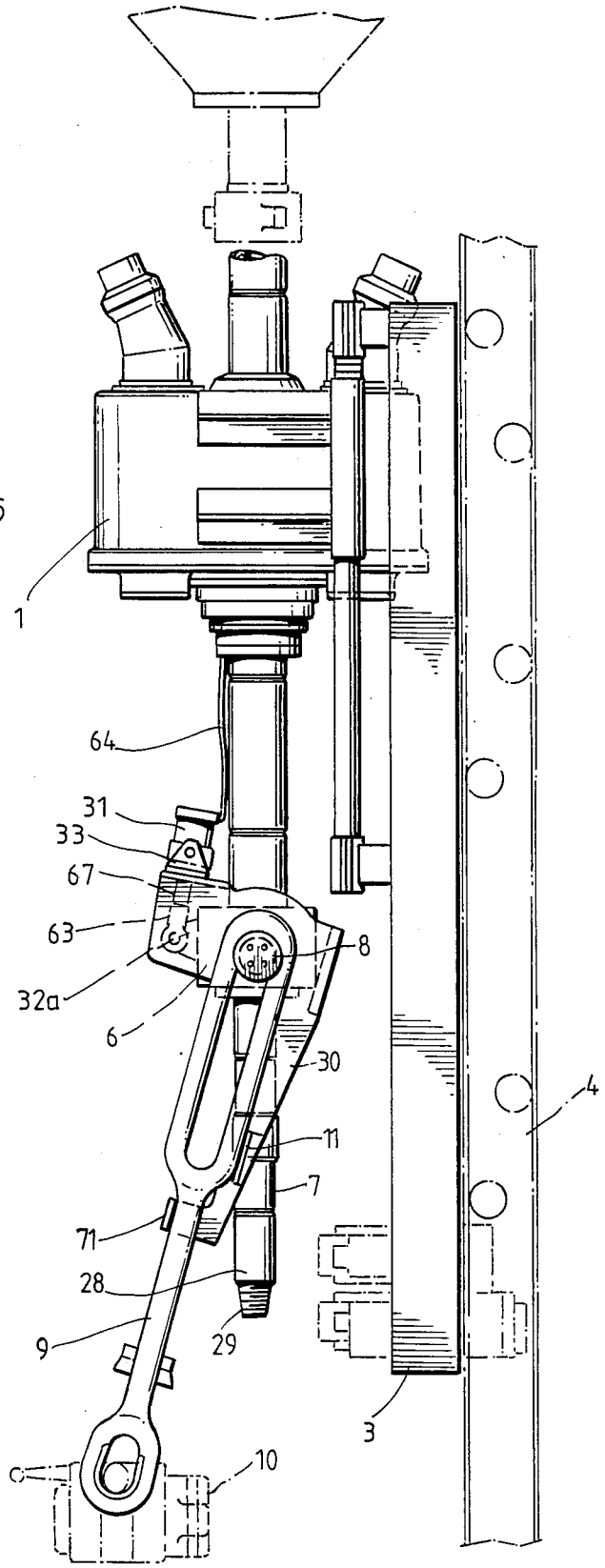
FIG. 6 is a side view of a tilt mechanism of the present invention with an elevator bowl means laterally swung away from a vertical position.

In FIG. 6 the air cylinder 31 is secured to the tilt mechanism 30. The cylinder 31 has an air piston rod 67 connected to a yoke 63 that is pivotably attached to the link adapter 6. The air cylinder 31 has been actuated with compressed gas through hose 64 and has exerted a force that reacts at clevis pin 32 that is inserted through the yoke 63 and the link adapter 6. This reaction against a cylinder trunnion 33 connected to the tilt mechanism 30 causes the tilt mechanism 30 to rotate about axis 54. Projection 11 then contacts link 9 and urges said link rotatively outward. The trunnions 33 are disposed about an elongated hole 35 which allows passage therethrough of a pin to hold the cylinder 31. Cylinder 31 is actuated with compressed gas (e.g. air) (or liquid). Trunnion 33 is connected to the tilt mechanism frame 30. These trunnions 33 are disposed about an elongated hole 35. The air line connections to cylinder 31 are not shown. When cross member 30*a* of the mechanism 30 contacts the link adapter 6, further rotation of the mechanism 30 is prevented. By configuring and positioning the cross member 30 any desired tilt angle can be achieved. Cylinder trunnion mount 33 is same as trunnion 33 of FIG. 6. A unique aspect of this invention is the provision of a power means for the link tilt mechanism which can provide power in both the outwardly tilting mode and the inwardly moving mode. In the preferred embodiments this is done by providing means for positively moving the piston of the air cylinder in either direction.

Figure 7A:
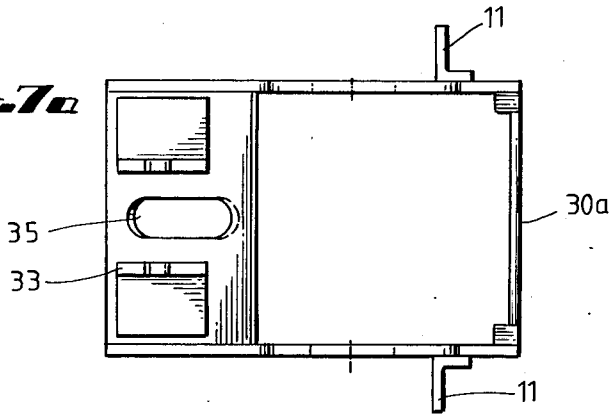
FIG. 7*a* is a side view of a portion of the tilt mechanism of FIG. 6.
Figure 7B:
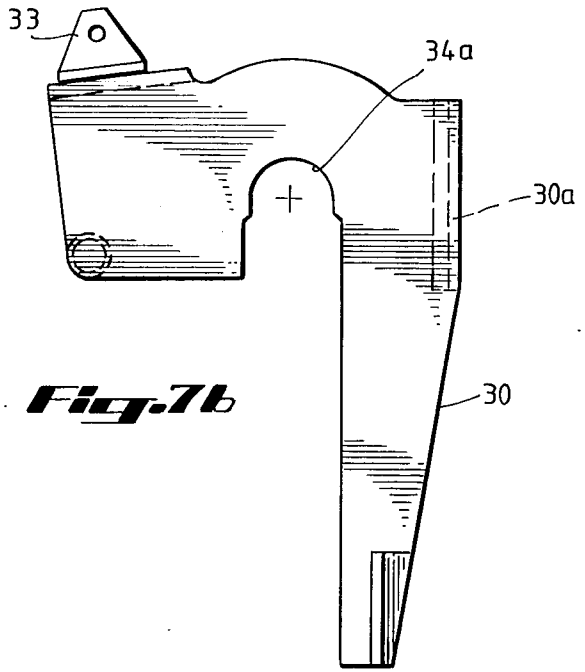
FIG. 7*b* is a top view of the apparatus of FIG. 7*a*.

In FIG. 7 the tilt mechanism 30 is shown with a hemispherically shaped bearing area 34 for mounting the tilt mechanism on the pins 8; projecting member 11; and cylinder trunnion mount 33. An elongated slot 35 is provided to allow the insertion of a cylinder rod 60 of the cylinder 31. The cylinder rod 60 reacts against the pin 32 (FIG. 6) since the pin 32 is rigidly fixed to a lug 32*a* (FIG. 9*b*), as the distance between the cylinder trunnion 33 and the pin 32 increases, the reaction pivots the mechanism 30 about a pivot radius 34*a*, which moves the elevator 10 to a position as shown in FIG. 6 (approximately 15° from vertical).

Figure 8A:
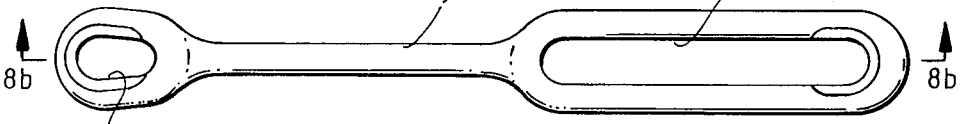
FIG. 8*a* is a plan view of an elongated elevator bail or link according to the present invention.
Figure 8B:
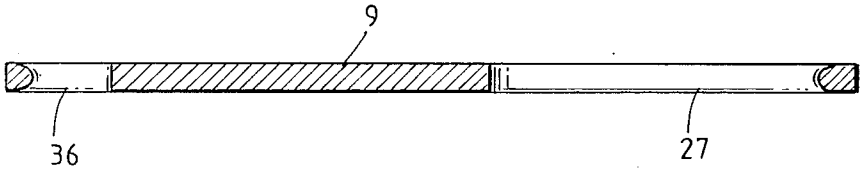
FIG. 8*b* is a sectional view of the bail or link of FIG. 8*a*.

As shown in FIGS. 8*a* and 8*b* the link 9 includes a shorter elongated slot 36 that is dimensioned to suit the particular elevator 10 which is used and the link 9 has an elongated slot 27.

Figure 9A:
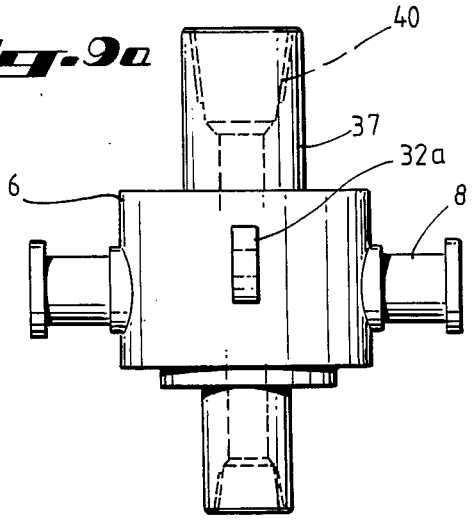
FIG. 9*a* is a front view of an elevator link adapter according to the present invention.
Figure 9B:
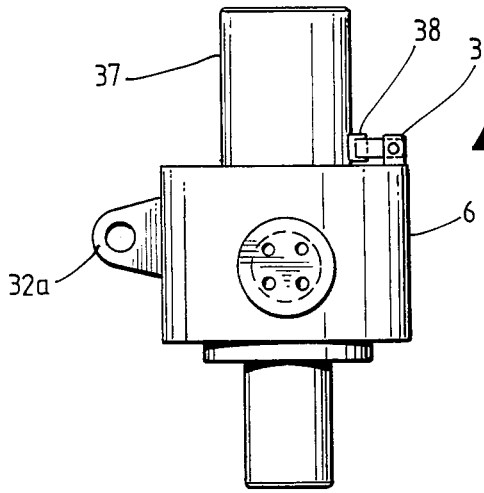
FIG. 9*b* is a side view of the adapter of FIG. 9*a*.
Figure 9C:
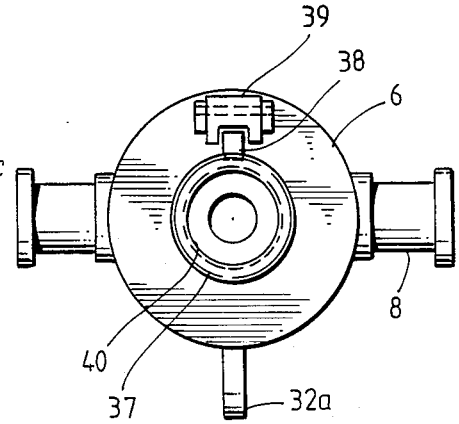
FIG. 9*c* is a top view of the adapter of FIG. 9*a*.

FIGS. 9*a*, 9*b* and 9*c* are plan, side and top views respectively of the link adapter 6. A shaft 37 has a threaded section 40 that is connectible to the top drive shaft 7. Shaft 37 is fitted with a key 38. Link adapter 6 is fitted with a hinged restraining arm 39 which when rotated toward the shaft 37 meshes with key 38 which effectively locks shaft 37 preventing rotation within the link adapter 6. Thus the link adapter 6 is prevented from rotating relative to the drilling shaft. Pivot lug 32*a* is securely attached to link adapter 6 and is the point of attachment for cylinder 31 at clevis pin 32.

Figure 10A:
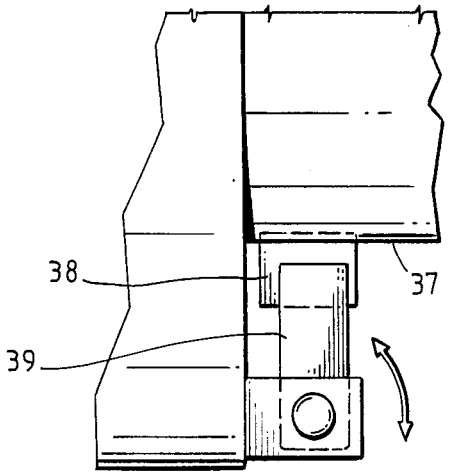
FIG. 10*a* is an enlarged side view of the adapter of FIG. 9*b* showing the latch mechanism of the adapter.
Figure 10B:
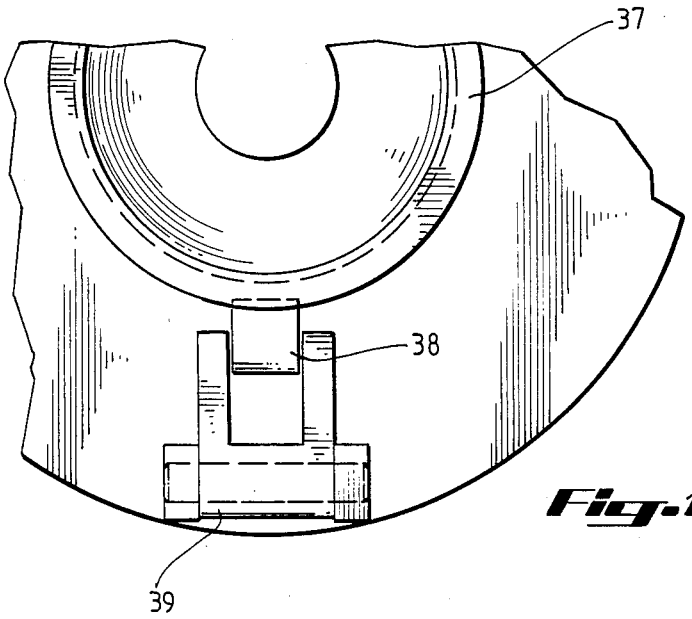
FIG. 10*b* is a top view of the mechanism shown in FIG. 10*a*.

FIGS. 10*a* and 10*b* show an enlarged view of the locking arrangement of key 38 and restraining arm 39.

Figure 11:
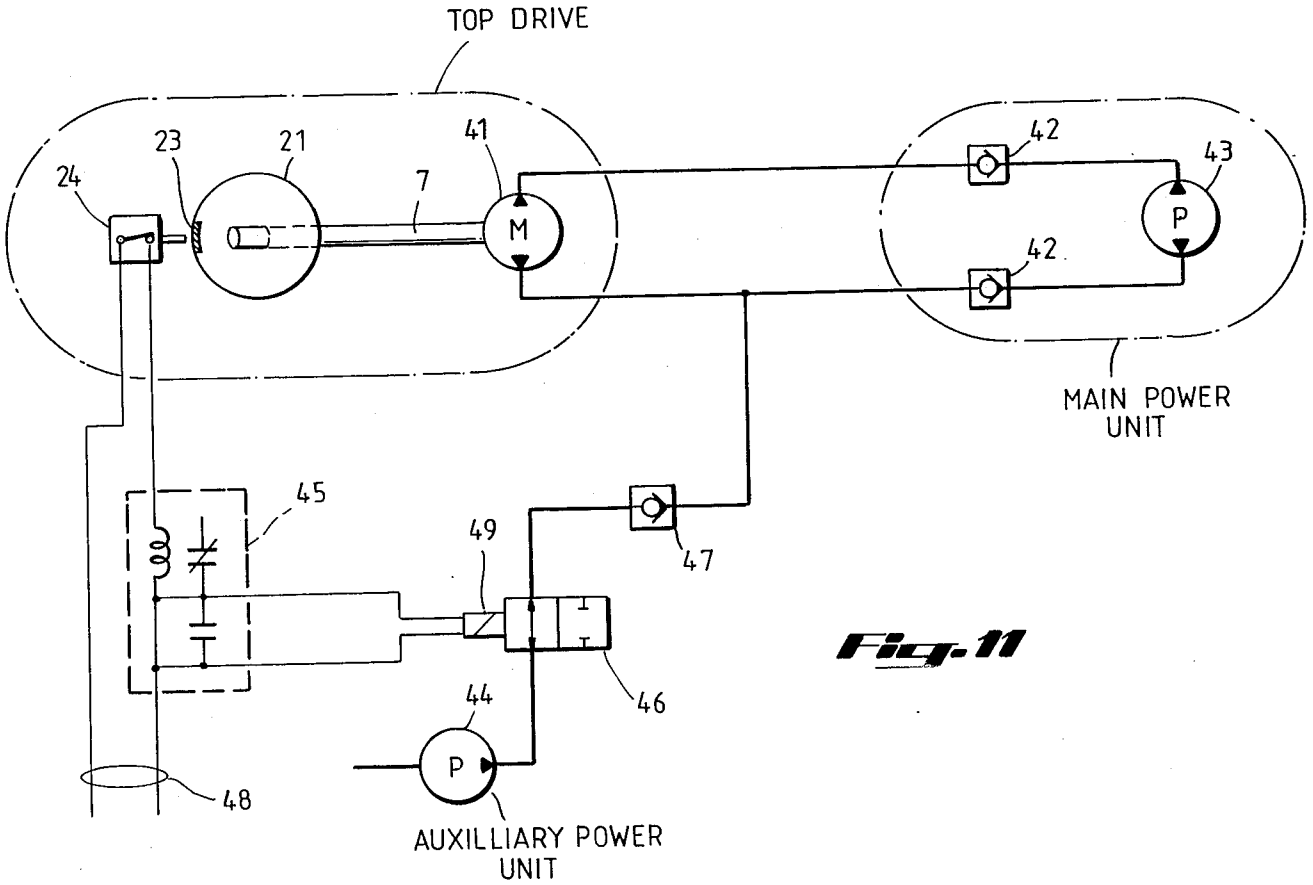
FIG. 11 is a schematic of a control system according to the present invention.

FIG. 11 is a schematic control system diagram. As the drilling drive shaft 7 rotates, the ring 21 (see FIG. 3) is caused to rotate together with 7. When the radially located sensing material 23 rotates within close proximity of the switch 24, electrical current conducted by wires 48 is caused to flow through a relay 45 which energizes a solenoid 49 shifting a valve 46 and thereby cutting off the flow of fluid from a fluid pump 44. Until this happens, fluid from the pump 44 is directed to a top drive motor 41 which rotates shaft 7. Check valves 42 prevent fluid from pump 44 from reaching a pump 43. During regular drilling, the pump 43 is active and the pump 44 is inactive.

As shown in FIGS. 12 and 13 a tilt mechanism 70 according to this invention, similar to the mechanism 30, can have second projecting members 71 for contacting elevator links to insure that upon inward movement the links will again be vertical, aligned with a well axis.

In FIG. 14, a compressed gas control circuit is shown that produces a double acting power stroke for cylinder 31 using a single compressed gas inlet. The circuit directs a pressurized gas to both ports of the cylinder thru a single pressurized supply but which is divided through two entry conductors, one of which embodys a pressure reducing valve and a one way check valve. The circuit design allows pressure to be discharged from one side only, thereby producing a double acting power source from a single supply. Compressed gas of desired pressure enters a conductor 74 with equal volume, dividing the flow at a tee 76. The gas entering the rodless side (the piston side) of the cylinder 31 exerts full force against a piston face 77. Simultaneously the gas enters a rod side cavity 78 of the cylinder 31, but at a reduced pressure which is effected by a pressure regulating valve 73. A one way check valve 72 allows flow into the cylinder, but blocks flow out. The superior pressure against piston 77 will overpower the lesser pressure in cavity 78 allowing the piston 77 to move and extend rod 67 to a maximum length. When the gas pressure is released and exhausts through conductor 74, only the gas from the piston side is released. The trapped gas pressure then urges the rod and piston to a minimum length. Thus the link tilt mechanism can be moved outwardly under controlled power and also moved inwardly under controlled power.

In conclusion, therefore, it is seen that the present invention and the embodiments disclosed herein are well adapted to carry out the objectives and obtain the ends set forth at the outset as well as others inherent therein. Certain changes can be made in the method and apparatus without departing from the spirit and the scope of this invention. While there have been described various embodiments of the present invention, the methods and apparatus described are not intended to be understood as limiting the scope of the invention. It is realized that changes therein are possible and it is further intended that each element recited in any of the following claims and each combination of elements is to be understood as referring to all equivalent elements or equivalent combinations for accomplishing substantially the same results in substantially the same or equivalent manner. It is intended that the claims cover the invention broadly in whatever form its principles may be utilized.

What is claimed is:

1. Well drilling apparatus for use in a derrick comprising:

a drilling unit including a rotary element adapted to be connected to the upper end of a drill string for rotation therewith about the axis of the string, and a motor operable to drive the element and the connected string rotatively about the axis;

an elongated guide structure mounted on the derrick which extends generally vertically parallel to the axis and which guides the drilling unit for movement upwardly and downwardly with a connected drill string to drill a well;

a link adapter connected to the string beneath the drilling unit;

two links having lower ends and having upper ends, the links rotatably connected to and rotatable with the link adapter for movement upwardly and downwardly therewith and in a relation suspending the links at opposite sides of the axis;

an elevator connected to lower ends of the links and adapted to support a section of the drill string in axial alignment with the well; and a power actuated link tilt mechanism mounted on the link adapter independently of the links, the link tilt mechanism operable to contact and move the lower ends of the links and the elevator suspended thereby laterally outwardly relative to the axis in a relation shifting the elevator between a first position in which it is beneath the drilling unit and aligned therewith along the axis to suspend a section of the drill string in axial alignment with the well and a second position in which the elevator is offset to a side of the axis and is not aligned with the drilling unit to engage a section of drill pipe offset from the axis while the drilling unit remains in alignment with the axis.

2. The apparatus of claim 1 wherein the drilling unit has a downwardly extending drilling shaft for connection to the drill string or to tubular intermediaries between the drilling shaft and the drill string and including also powered indexing means for positioning the drilling shaft, the powered indexing means comprising an annular ring disposed about and rotatable with the drilling shaft, the annular ring having a sense material portion which can be sensed, a sensor disposed near the ring for sensing the sense material portion and sending a signal to a controlled power actuator for moving the drilling shaft of the drilling unit to a desired position.

3. The apparatus of claim 2 wherein the sense material portion is magnetic material and the sensor is able to sense magnetic material.

4. The apparatus of claim 2 wherein the annular ring is sealingly mounted about the drill string.

5. Well drilling apparatus for use in a derrick having a derrick floor, the apparatus comprising:

a drilling unit including a rotary element adapted to be connected to the upper end of a drill string for rotation therewith about the axis of the string, and a motor operable to drive the element and the connected string rotatively about the axis;

an elongated guide structure connected to the derrick which extends generally vertically parallel to the axis to which the drilling unit is movably mounted and which guides the drilling unit for movement upwardly and downwardly with a connected drill string to drill a well;

a link adapter connected to the drilling unit, the link adapter having two radially extending supports for supporting elevator links;

two elevator links having lower ends and having upper ends movably connected to the link adapter for movement upwardly and downwardly therewith and in a relation suspending the links at opposite sides of the axis, the links movable from a first position over the axis to a second position to the side of the axis;

an elevator connected to lower ends of the links and suspended thereby beneath the drilling unit and adapted to support a section of the drill string in axial alignment with the axis; and a link tilt mechanism rotatably mounted on the link adapter, the link tilt mechanism comprising a body member movably mounted on the link adapter, two arms extending downwardly from the body member, the arms disposed between the links, a first arm projection projecting from each arm outwardly, each first arm projection disposed so that upon tilting of the body member toward the axis the first arm projections contact the links thereby tilting the links to the second position, and power means connected between the link tilt mechanism and the link adapter, the power means operable to move the arms and arm projections of the link tilt mechanism laterally outwardly from said axis, bringing the arm projections into contact with the links and thereby shifting the links and the elevator connected thereto from the first position beneath the drilling unit and aligned with the axis to the second position in which the elevator is offset to the side of the axis and is not aligned with the drilling unit, enabling the elevator to engage a section of drill pipe offset from the axis while the drilling unit remains in alignment with the axis.

6. The apparatus of claim 5 wherein a tubular shaft is disposed through and secured to the link adapter, the shaft threaded at either end to provide means for connection to the drilling unit above the adapter and a threaded element below the adapter.

7. The apparatus of claim 5 wherein the link tilt mechanism's body member has two inverted U-shaped recesses therein for rotatably mounting the link tilt mechanism on the link adapter radially extending supports.

8. The apparatus of claim 5 wherein each link has an elongated slot through which its corresponding link adapter radially extending support extends, the elongated slots permitting further downward movement to the extent of the length of the elongated slots of the drilling unit after the links have contacted the derrick floor.

9. The apparatus of claim 5 wherein the body member of the link tilt mechanism includes a cross member extending between the two arms and disposed adjacent the link adapter so that after the link tilt mechanism has rotated to a desired angle the cross member contacts the link adapter preventing further rotation of the link tilt mechanism.

10. The apparatus of claim 5 including also an air swivel for providing compressed air to provide power for the link tilt mechanism, the air swivel comprising a first annular seal member secured to the drilling unit, the first annular seal member having an outwardly extending flange and having channel means therein and therethrough for conducting compressed fluid into a first annulus around the first annular seal member, a second annular seal member secured to the rotary element of the drilling unit, the second annular seal member having an upwardly extending flange contacting the outwardly extending flange of the first annular seal member, the first annulus being formed between the flange of the second annular seal member and the first annular seal member, the second annular seal member having a passage therethrough for conducting the compressed fluid from the first annulus to an exit port in the second annular seal member, the exit port suitable for connection thereto of a hose for conducting the compressed fluid to the link tilt mechanism.

11. The apparatus of claim 5 wherein each arm of the link tilt mechanism has a second arm projection for contacting the links during movement from the second position to the first position to insure that the links return to a vertical position above the axis.

12. The apparatus of claim 5 wherein the power means comprises an air cylinder housing having a movable air piston therein and a piston rod connected to the air piston and extending partially from the housing, the air cylinder housing mounted on the link tilt mechanism and the air piston secured to the link adapter so that movement of the air piston and its connected piston rod effects rotation of the link tilt mechanism about the link adapter radially extending supports.

13. The apparatus of claim 12 in which controlled movement of the air piston effects movement of the links to the second position.

14. The apparatus of claim 12 in which controlled movement of the air piston effects movement of the links to the first position.

15. A link tilt mechanism for well drilling apparatus for use in a derrick having a derrick floor, the well drilling apparatus having a drilling unit including a rotary element adapted to be connected to the upper end of a drill string for rotation therewith about the axis of the string, and a motor operable to drive the element and the connected string rotatively about the axis, an elongated guide structure connected to the derrick which extends generally vertically parallel to the axis to which the drilling unit is movably mounted and which guides the drilling unit for movement upwardly and downwardly with a connected drill string to drill a well, a link adapter connected to the drilling unit, the link adapter having two radially extending link adapter supports for supporting elevator links, two elevator links having lower ends and having upper ends movably connected to the link adapter for movement upwardly and downwardly therewith and in a relation suspending the links at opposite sides of the axis, each link's upper end having an elongated slot through which its corresponding link adapter support extends, the elongated slots permitting further downward movement to the extent of the slot's length of the drilling unit after the links' lower ends have contacted the derrick floor, the links movable from a first position over the axis to a second position to the side of the axis, an elevator connected to lower ends of the links and suspended thereby beneath the drilling unit and adapted to support a section of the drill string in axial alignment with the axis, the link tilt mechanism comprising:

a body member movably mounted on the link adapter, the body member having two recesses therein for rotatably mounting the mechanism on the link adapter supports, two arms extending dowwardly from the body member, the arms disposed between the links, a first arm projection projecting from each arm outwardly, each first arm projection disposed so that upon tilting of the body member toward the axis the first arm projections contact the links thereby tilting the links to the second position, and power means connected between the link tilt mechanism and the link adapter, the power means operable to move the arms and their arm projections of the link tilt mechanism laterally outwardly from said axis, bringing the arm projections into contact with the links and thereby shifting the links and the elevator connected thereto from the first position beneath the drilling unit and aligned with the axis to the second position in which the elevator is offset to the side of the axis and is not aligned with the drilling unit, enabling the elevator to engage a section of drill pipe offset from the axis while the drilling unit remains in alignment with the axis, the power means comprising an air cylinder housing having a movable air piston therein and a piston rod connected to the air piston and to the link adapter extending partially from the housing, the air cylinder housing on the link tilt mechanism and the air piston secured to the link adapter so that movement of the air piston and its connected rod effects rotation of the link tilt mechanism about the link adapter extending supports.

16. An elevator link for supporting an elevator, the elevator having radially extending first supports and for connection to an intermediate assembly disposed beneath a drilling unit, the intermediate assembly having radially extending second supports, the link comprising a central shaft having an upper end and a lower end, the lower end having an opening therethrough for receiving one of the radially extending first supports of the elevator, the upper end having an elongated slot therein for receiving a second support of the intermediate assembly, the elongated slot having a substantially constant width along a major portion of its length the elongated slots permitting downward movement therein of the second supports after the link has contacted an obstruction beneath the link which prevents further downward motion of the link, the elongated slot configured to guide the link and to maintain its vertical position.

17. A powered indexing device for positioning a drilling unit, the drilling unit having a downwardly extending drilling shaft for connection to a drill string, the powered indexing device comprising an annular ring disposed about and rotatable with the drilling shaft, the annular ring having a sense material portion which can be sensed, and a sensor disposed near the ring for sensing the sense material portion and sending a signal to a controlled power actuator which is operatively connected to a power actuator for moving the drilling shaft to a desired position.

* * * * *